US011098988B1

(12) United States Patent
Colosimo et al.

(10) Patent No.: US 11,098,988 B1
(45) Date of Patent: Aug. 24, 2021

(54) APPARATUS FOR A DIRECTED-ENERGY WEAPON

(71) Applicant: BAE Systems plc, London (GB)

(72) Inventors: Nicholas Giacomo Robert Colosimo, Preston (GB); Keith Antony Rigby, Preston (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 16/972,333

(22) PCT Filed: Jun. 13, 2019

(86) PCT No.: PCT/GB2019/051637
§ 371 (c)(1),
(2) Date: Dec. 4, 2020

(87) PCT Pub. No.: WO2019/239135
PCT Pub. Date: Dec. 19, 2019

(30) Foreign Application Priority Data

Jun. 13, 2018 (EP) ..... 18275080
Jun. 13, 2018 (GB) ..... 1809672

(51) Int. Cl.
*F41H 13/00* (2006.01)

(52) U.S. Cl.
CPC ..... *F41H 13/0062* (2013.01); *F41H 13/0043* (2013.01)

(58) Field of Classification Search
CPC ..... F41H 13/0043; F41H 13/0062; F41H 13/0075; F41H 13/0068; F41H 13/00
See application file for complete search history.

(56) References Cited

U.S. PATENT DOCUMENTS

| | | | |
|---|---|---|---|
| 3,946,233 A | 3/1976 | Erben et al. | |
| 4,614,913 A | 9/1986 | Honeycutt et al. | |
| 5,837,918 A | 11/1998 | Sepp | |
| 6,396,577 B1 | 5/2002 | Ramstack | |
| 6,723,974 B1 | 4/2004 | Sepp | |
| 7,405,834 B1 | 7/2008 | Marron et al. | |
| 9,285,463 B1 | 3/2016 | Freeman | |
| 9,689,976 B2 * | 6/2017 | Parker | G01S 13/86 |

(Continued)

FOREIGN PATENT DOCUMENTS

| | | |
|---|---|---|
| DE | 10252685 A1 | 6/2004 |
| DE | 102010053896 A1 | 6/2012 |

(Continued)

OTHER PUBLICATIONS

International Search Report and Written Opinion for PCT Appl. No. PCT/GB2019/051637, dated Sep. 13, 2019, 13 Pages.

(Continued)

*Primary Examiner* — Arman B Fallahkhair
(74) *Attorney, Agent, or Firm* — Maine Cernota & Rardin

(57) ABSTRACT

An apparatus for a directed-energy weapon comprises an assessment system arranged to, during an assessment phase, perform an assessment of a target environment, wherein the target environment comprises a target, and the assessment comprises receiving data relating to a map of at least a portion of a target environment; and a controller arranged to, during an engaging phase, control the directed-energy weapon to direct energy towards the target environment conditionally upon the data.

13 Claims, 6 Drawing Sheets

(56) References Cited

U.S. PATENT DOCUMENTS

| | | | | |
|---|---|---|---|---|
| 10,330,440 | B2 * | 6/2019 | Lyren | G02B 27/0172 |
| 2006/0022115 | A1 * | 2/2006 | Byren | G01J 9/00 250/201.9 |
| 2009/0182525 | A1 * | 7/2009 | Schultz | F41H 13/0068 702/127 |
| 2010/0289686 | A1 * | 11/2010 | Jung | F42D 5/04 342/14 |
| 2012/0098693 | A1 | 4/2012 | Bradley | |
| 2012/0232867 | A1 | 9/2012 | Ahrens | |
| 2014/0125964 | A1 * | 5/2014 | Jonas | F41H 13/0043 356/4.01 |
| 2015/0293210 | A1 | 10/2015 | Protz | |

FOREIGN PATENT DOCUMENTS

| | | | |
|---|---|---|---|
| EP | 0911646 | A2 | 4/1999 |
| EP | 0922968 | A2 | 6/1999 |
| EP | 2738513 | A1 | 6/2014 |
| WO | 2010138226 | A2 | 12/2010 |
| WO | 2016024265 | A1 | 2/2016 |

OTHER PUBLICATIONS

International Search Report and Written Opinion for PCT Appl. No. PCT/GB2019/051638, dated Jul. 31, 2019, 12 Pages.

Search Report for European Patent Appl. No. 18275078.6, dated Nov. 15, 2018, 8 Pages.

Search Report for Great Britain Patent Appl. No. 1809667.7, dated Dec. 18, 2018, 4 Pages.

International Search Report and Written Opinion for PCT Appl. No. PCT/GB2019/051637, dated Sep. 6, 2019, 13 Pages.

Search Report for European Patent Appl. No. 18275080.2, dated Nov. 23, 2018, 10 Pages.

Search Report for Great Britain Patent Appl. No. 1809672.7, dated Dec. 18, 2018, 5 Pages.

International Search Report and Written Opinion for PCT Appl. No. PCT/GB2019/051636, dated Sep. 5, 2019, 13 Pages.

Search Report for European Patent Appl. No. 18275079.4, dated Nov. 22, 2018, 10 Pages.

Search Report for Great Britain Patent Appl. No. 1809671.9, dated Dec. 12, 2018, 3 Pages.

* cited by examiner

APPARATUS FOR A DIRECTED-ENERGY WEAPON

RELATED APPLICATIONS

This application is a national phase application filed under 35 USC § 371 of PCT Application No. PCT/GB2019/051637 with an International filing date of Jun. 13, 2019 which claims priority of GB Patent Application 1809672.7 filed Jun. 13, 2018 and EP Patent Application 18275080.2 filed Jun. 13, 2018. Each of these applications is herein incorporated by reference in its entirety for all purposes.

The invention relates to an apparatus for a directed-energy weapon and a method of engaging a target.

Directed-energy weapons (DEWs) are becoming more powerful in order to ensure that they can effectively engage a target. However, as the power of such weapons increases, the risk of collateral damage to items other than the target in a target environment increases. It is desirable to reduce the risk of collateral damage. Whilst the primary consideration in the development of directed-energy weapons has historically been an increase in power of the DEW, other components or functionality of the DEW haves been overlooked or neglected.

According to a first aspect, there is provided an apparatus for a directed-energy weapon, the apparatus comprising an assessment system arranged to, during an assessment phase, perform an assessment of a target environment, wherein the target environment comprises a target, and the assessment comprises determining a possible engagement efficiency of the target by a directed-energy weapon, and a controller arranged to, during an engaging phase, control the directed-energy weapon to direct energy towards the target environment conditionally upon the possible engagement efficiency.

Such an apparatus is advantageous, as the possible engagement efficiency (i.e. the proportion of energy directed towards the target environment which would pass into or onto a target if the target were engaged, for example being coupled to or into the target, for example by absorption) gives a measure of how effective the directed-energy weapon would be in engaging the target, and/or how much energy is reflected from the target, which may result in collateral damage to objects adjacent to the target in the target environment. The controller then controls the directed-energy weapon to direct energy towards the target environment conditionally upon the possible engagement efficiency. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold. The target environment comprises the target, and may include all other areas which may be affected by the directed-energy weapon during engagement of the target (for example, due to energy reflected from the target).

In one example, the assessment comprises receiving data relating to a map of at least a portion of a target environment; and a controller arranged to, during an engaging phase, control the directed-energy weapon to direct energy towards the target environment conditionally upon the data.

Such an apparatus is advantageous, as the data relating to the map allows the directed-energy weapon to determine various parameters to reduce collateral damage and/or increase the effectiveness of the weapon. These parameters include:

engagement efficiency (as described above), for example, by determining an angle of a surface of the target to determine how much energy will be deflected from the target;

collateral damage, for example, by using the map to determine objects adjacent to the target which may receive directed energy, either directly or reflected from the target; and time for which there is a continuous line of sight from the directed-energy weapon to the target.

The controller then controls the directed-energy weapon to direct energy towards the target environment conditionally upon the data or on the above-described parameters which depend on the data. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold.

In one example, the controller is arranged to control the directed energy weapon to direct energy toward the target environment during the assessment phase so that the assessment system can perform the assessment of the target environment using the directed energy. Using the directed-energy weapon itself to perform the assessment is advantageous, as it means that a separate system is not required. The energy could be from a main or weapon beam, or from a probing beam. Where separate main and probing beams are used, they may include some shared components, for example, a shared optical system. The energy could be used to obtain the map data, for example via reflection or other deflection from the target environment.

According to a second aspect, there is provided an apparatus for a directed-energy weapon, the apparatus comprising an assessment system arranged to, during an assessment phase, perform an assessment of a target environment, wherein the target environment comprises a target, and the assessment comprises receiving data relating to a map of at least a portion of a target environment; and a controller arranged to, during an engaging phase, control the directed-energy weapon to direct energy towards the target environment conditionally upon the data.

Such an apparatus is advantageous, as the data relating to the map allows the directed-energy weapon to determine various parameters to reduce collateral damage and/or increase the effectiveness of the weapon. These parameters include:

engagement efficiency (i.e. the proportion of energy directed towards the target environment which would pass into the target), for example, by determining an angle of a surface of the target to determine how much energy will be reflected from the target;

collateral damage, for example, by using the map to determine objects adjacent to the target which may receive directed energy, either directly or reflected from the target; and time for which there is a continuous line of sight from the directed-energy weapon to the target.

The controller then controls the directed-energy weapon to direct energy towards the target environment conditionally upon the data, or on the above-described parameters which depend on the data. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold.

In one example, the controller is arranged to control the directed energy weapon to direct energy toward the target environment during the assessment phase so that the assessment system can perform the assessment of the target environment using the directed energy. Using the directed-energy weapon itself to perform the assessment is advantageous, as it means that a separate system is not required.

In one example, the assessment comprises determining a possible engagement efficiency of the target by a directed-energy weapon; and the controller is arranged to, during an engaging phase, control the directed-energy weapon to direct energy towards the target environment conditionally upon the possible engagement efficiency.

Such an apparatus is advantageous, as the possible engagement efficiency (as described above) gives a measure of how effective the directed-energy weapon would be in engaging the target, and/or how much energy is reflected from the target and may result in collateral damage to objects adjacent to the target in the target environment. The controller then controls the directed-energy weapon to direct energy towards the target environment conditionally upon the possible engagement efficiency. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold.

According to a third aspect, there is provided an apparatus for a directed-energy weapon, the apparatus comprising: an assessment system arranged to, during an assessment phase, perform an assessment of a target environment, wherein the target environment comprises a target; and a controller arranged to, during the assessment phase, control the directed energy weapon to direct energy towards the target environment so that the assessment system can perform the assessment using the directed energy.

Using the directed-energy weapon to perform the assessment is advantageous, as it means that a separate system for assessment is not required. The types of assessment which may be performed include mapping the target environment or determining engagement efficiency (i.e. the proportion of energy directed towards the target environment which would pass into the target). Both of these assessments allow the risk of collateral damage to objects in the target environment to be calculated.

In one example, the controller is arranged to, during an engaging phase, control the directed-energy weapon to direct energy towards the target environment conditionally upon the assessment.

In one example, the assessment comprises determining a possible engagement efficiency of the target by a directed-energy weapon and the controller is arranged to, during an engaging phase, control the directed-energy weapon to direct energy towards the target environment conditionally upon the possible engagement efficiency. Such an apparatus is advantageous, as the possible engagement efficiency (as described above) gives a measure of how effective the directed-energy weapon would be in engaging the target, and/or how much energy is reflected from the target and which may result in collateral damage to objects adjacent to the target in the target environment. The controller then controls the directed-energy weapon to direct energy towards the target environment conditionally upon the possible engagement efficiency. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold.

In one example, the assessment comprises receiving data relating to a map of at least a portion of a target environment; and a controller arranged to, during an engaging phase, control the directed-energy weapon to direct energy towards the target environment conditionally upon the data.

Such an apparatus is advantageous, as the data relating to the map allows the directed-energy weapon to determine various parameters to reduce collateral damage and/or increase the effectiveness of the weapon. These parameters include:

engagement efficiency (as described above), for example, by determining an angle of a surface of the target to determine how much energy will be reflected from the target;

collateral damage, for example, by using the map to determine objects adjacent to the target which may receive directed energy, either directly or reflected from the target; and time for which there is a continuous line of sight from the directed-energy weapon to the target.

The controller then controls the directed-energy weapon to direct energy towards the target environment conditionally upon the data or on the above-described parameters which depend on the data. This may include not engaging the target, or engaging the target, or engaging the target at a lower power, thereby avoiding or reducing collateral damage, as described below. The same apparatus may simply be used to more effectively engage a target, for example only engaging when engagement efficiency is at or above a threshold.

The features of the following examples may be used in any of the first, second and third aspects described above.

In one example, the controller is arranged to, during the assessment phase, control the directed energy weapon to: direct energy at a lower power than during an engaging phase; direct energy at a higher beam divergence than during an engaging phase; sweep or otherwise selectively move directed energy across different points in the target environment; pulse directed energy toward the target environment. Each of these options means that the target environment receives less energy during the assessment, reducing the likelihood of collateral damage during the assessment. This reduction in energy might also be useful simply to prevent or limit damage to the target during an assessment phase. This could then also be a warning phase. In one example, the controller is arranged to, during the assessment phase, control the directed energy to direct electromagnetic energy at a different wavelength from that of the engaging phase. The wavelength used in the assessment phase may be a wavelength which is less likely to cause eye injuries, for example at a wavelength greater than 1.4

In one example, the controller is arranged to, during the assessment phase, control the directed-energy weapon to use a main beam (i.e. a primary beam) to direct energy, and, during the engaging phase, control the directed-energy weapon to use the main beam to direct energy. Additionally, as it is the main beam which may direct energy during the engaging phase, it is desirable to have the assessment performed from a point of view as close as possible to that of the main beam. This can be best achieved by using the main beam during the assessment phase to perform the assessment.

In one example, the controller is arranged to, during the assessment phase, control the directed-energy weapon to use a probing beam (i.e. a secondary beam) to direct energy, and, during the engaging phase, control the directed-energy weapon to use a main beam to direct energy. Using the probing beam to perform the assessment is advantageous, as the probing beam can be designed for the specific purpose of performing the assessment (for example, being set to direct energy at the appropriate power), increasing the accuracy of the assessment. The probing beam may be coaxial (that is, share a same beam bath) as the main beam, at least in part, which might make it easier to calculate engagement based on the assessment (e.g. spatial offsets in main and probing beams may not need to be taken into account).

In one example, the assessment comprises detecting energy deflected from the target environment to determine possible engagement efficiency. In one example, the assessment comprises measuring the temperature of the target environment to determine the possible engagement efficiency. This may be the temperature of the target (for example, a part into or onto which energy is directed). Measuring the temperature of the target allows the amount of energy deflected from the target to be calculated, thereby providing a measure of possible engagement efficiency. It may be easier to measure a temperature than it is to measure energy otherwise deflected from objects surrounding a target. In contrast, energy otherwise deflected from objects surrounding a target may be used to establish mapping information or data for the general target environment.

In one example, the assessment comprises using the data relating to the map to determine an angle of a region of the target to determine possible engagement efficiency. Measuring the angle of a region of the target allows the amount of energy reflected from the target to be estimated.

In one example, wherein the assessment comprises mapping at least a portion of the target environment to obtain the data relating to the map. Having the assessment system perform the mapping just before engaging the target allows a live map to be produced, providing more accurate data.

In one example, the assessment comprises detecting energy deflected from the target environment to determine the data relating to the map.

In one example, the controller is arranged to, during the engaging phase: in response to the possible engagement efficiency being below a first predetermined level, control the directed-energy weapon not to direct energy towards the target environment; and in response to the possible engagement efficiency being above the first predetermined level, control the directed-energy to direct energy towards the target environment. This helps to avoid collateral damage to the objects in the target environment as a result of reflection of energy due to low engagement efficiency.

In one example, the controller is arranged to, during the engaging phase: in response the possible engagement efficiency being below a second predetermined level, control the directed energy weapon to direct energy towards the target environment at a first power level; and in response to the possible engagement efficiency being above the second predetermined level, control the directed energy weapon to direct energy towards the target environment at a second power level, wherein the second power level is greater than the first power level. This helps to avoid collateral damage to the objects in the target environment as a result of reflection of energy due to low possible engagement efficiency.

In one example, the assessment comprises determining a risk of collateral damage by determining the possible engagement efficiency of the target, and wherein the controller is arranged to, during the engaging phase, control the directed-energy weapon to direct energy towards the target conditionally upon the risk of collateral damage. The material from which the target is made affects how energy is reflected from the target. This affects how much reflected energy reaches items adjacent to the target and the risk of collateral damage, Therefore, in some examples, the material of certain targets may be known in advance, for example from a material library for certain targets, and this information may be used in the assessment of risk of collateral damage. Additionally, in some examples, the material may be inferred from measurements, for example by detecting energy reflected from the target.

In one example, the assessment system is arranged to, in response to the assessment of the target environment (for example, the possible engagement efficiency, the time for which there is a continuous line of sight between weapon and target, and/or the risk of collateral damage), perform a second assessment of the target environment, wherein the second assessment is centred on a different point to the (first) assessment of the target environment. This allows the apparatus to find a better point at which to engage the target.

In one example, the apparatus further comprises the directed-energy weapon, wherein the directed-energy weapon is optionally a laser.

In one example, the controller is arranged to: during the assessment phase, receive information on a speed and direction of travel of the apparatus, and use the information and the data relating to the map to determine a time for which there is a continuous line of sight from the directed-energy weapon to the target, and, optionally, during the engaging phase, control the directed-energy weapon to engage the target conditionally upon the time for which there is a continuous line of sight. Determining the time for which there is a continuous line of sight means that the controller is aware of the time for which a target can be engaged effectively and/or without causing collateral damage. As used anywhere herein "causing collateral damage" could be any degree of collateral damage, for example an acceptable level of collateral damage.

In one example, the assessment of the target environment comprises determining risk of collateral damage by using the data relating to the map to determine objects adjacent to the target. This may be based on the types of objects present in the target environment, or number of objects, or distance of objects from the target, and so on.

In one example, the controller is arranged to, during the engaging phase: in response to the time for which there is a continuous line of sight from the directed-energy weapon to the target being below a first predetermined level, control the directed energy weapon not to direct energy towards the target; and in response to the time for which there is a continuous line of sight from the directed-energy weapon to the target being above the first predetermined level, control the directed energy weapon to direct energy towards the target. As described above, this can avoid or limit collateral damage to objects which enter the line of sight of the directed-energy weapon, and/or increase engagement effectiveness.

According to a fourth aspect, there is provided a military vehicle comprising the apparatus as described above. In an example, the military vehicle is an aircraft. In another example, the military vehicle is a naval vessel. In another example, the military vehicle is a terrestrial vehicle or platform. The invention might be particularly suited to use with aircraft, given the rapidly changing environment in which an aircraft operates owing to an aircraft's speed and vantage point.

According to a fifth aspect, there is provided a method of engaging a target, the method comprising: during an assessment phase, performing an assessment of a target environment, wherein the target environment comprises a target, and the assessment comprises determining a possible engagement efficiency of the target by a directed-energy weapon; and during an engaging phase, controlling the directed-energy weapon to direct energy towards the target environment conditionally upon the possible engagement efficiency of the target.

According to a sixth aspect, there is provided a method of engaging a target, the method comprising: during an assessment phase, receiving data relating to a map of at least a portion of a target environment, the target environment comprising a target; and during an engaging phase, controlling a directed-energy weapon to direct energy towards the target environment conditionally upon the map.

According to a seventh aspect, there is provided a method comprising, during an assessment phase, performing an assessment of a target environment by controlling a directed-energy weapon to direct energy, wherein the target environment comprises a target, and using the directed energy to perform the assessment.

For a better understanding of the invention reference is made, by way of example only, to the accompanying figures, in which.

The following figures demonstrate how the concepts used above may be used in combination, or at least partially overlapping with each other in terms of functionality. Of course, the concepts discussed above may be used in isolation or in any particular combination, as required.

Figure 1:
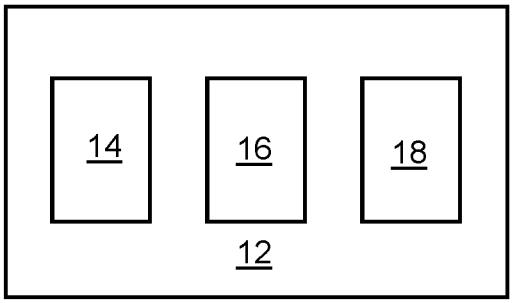
FIG. 1 shows a schematic drawing of an apparatus, according to an example embodiment.

Referring to FIG. 1 there is shown an apparatus 12. The apparatus 12 comprises an assessment system 14, a controller 16, and a directed-energy weapon 18. In this example, the directed-energy weapon 18 is a laser.

The assessment system 14 (or apparatus 12 in general) may comprise one or more lenses (not shown) to be used in the transmission and/or reception of energy, and/or a sensor (not shown) for sensing energy (e.g. a 2D sensor/focal plane array). The directed-energy weapon 18 comprises an energy generator (not shown), which will be a laser when the required/used energy is laser energy. The assessment system 14 (or apparatus 12 in general) may be reconfigurable, for example from one state to another, to selectively implement transmission/generation of energy, or detection of energy, and/or from an assessment phase to an engaging phase. For example, one or more optical components may be moved or otherwise controlled to change one or more beam paths within or about the apparatus 12.

In other examples, a directed-energy weapon could use another form of electromagnetic radiation, or pressure waves.

Figure 2:
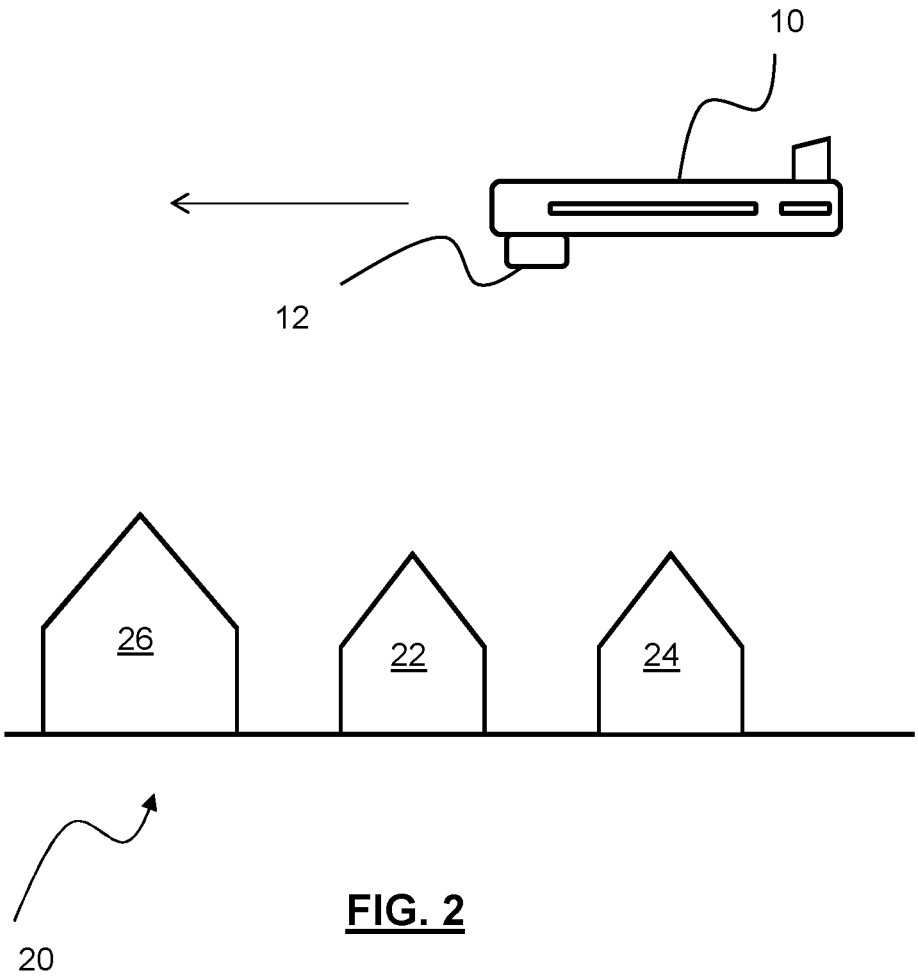
FIG. 2 shows a side view of a vehicle, according to an example embodiment.

Referring to FIG. 2, there is shown a vehicle 10 comprising the apparatus 12. In this example, the vehicle 10 is a military vehicle 10. The military vehicle is an aircraft. The apparatus 12 is mounted to an underside of the vehicle 10, such that there is a direct line of sight between the apparatus 12 and the ground on which a target environment 20 is located.

The vehicle 10 is travelling near to the target environment 20. The target environment 20 comprises a target 22, a first adjacent object 24 and a second adjacent object 26. In such a scenario, it is desirable to engage the target 22 as effectively as possible, whilst optionally minimising the risk of collateral damage to items other than the target 22 in the target environment 20 (i.e. the first adjacent object 24 and the second adjacent object 26).

Figure 3:
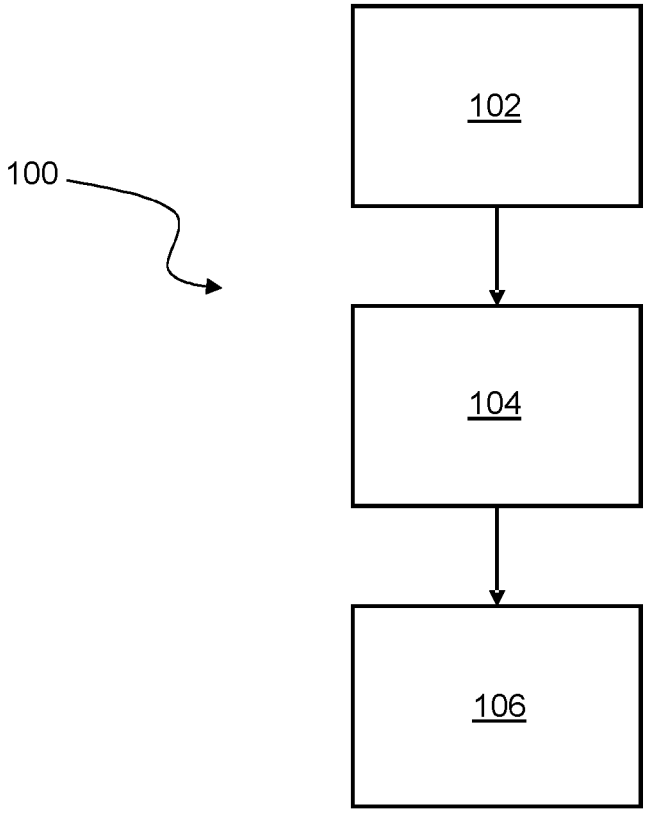
FIG. 3 shows a schematic drawing of method, according to an example embodiment.

Referring to FIG. 3 there is shown a method 100 which is performed by the apparatus 12. The method 100 comprises an assessment phase 102, during which an assessment of the target environment 20 is performed, an engaging phase 104 and a second assessment phase 106, during which a second assessment of the target environment 20 is performed. The steps of method 100 are explained in more detail below.

Figure 4:
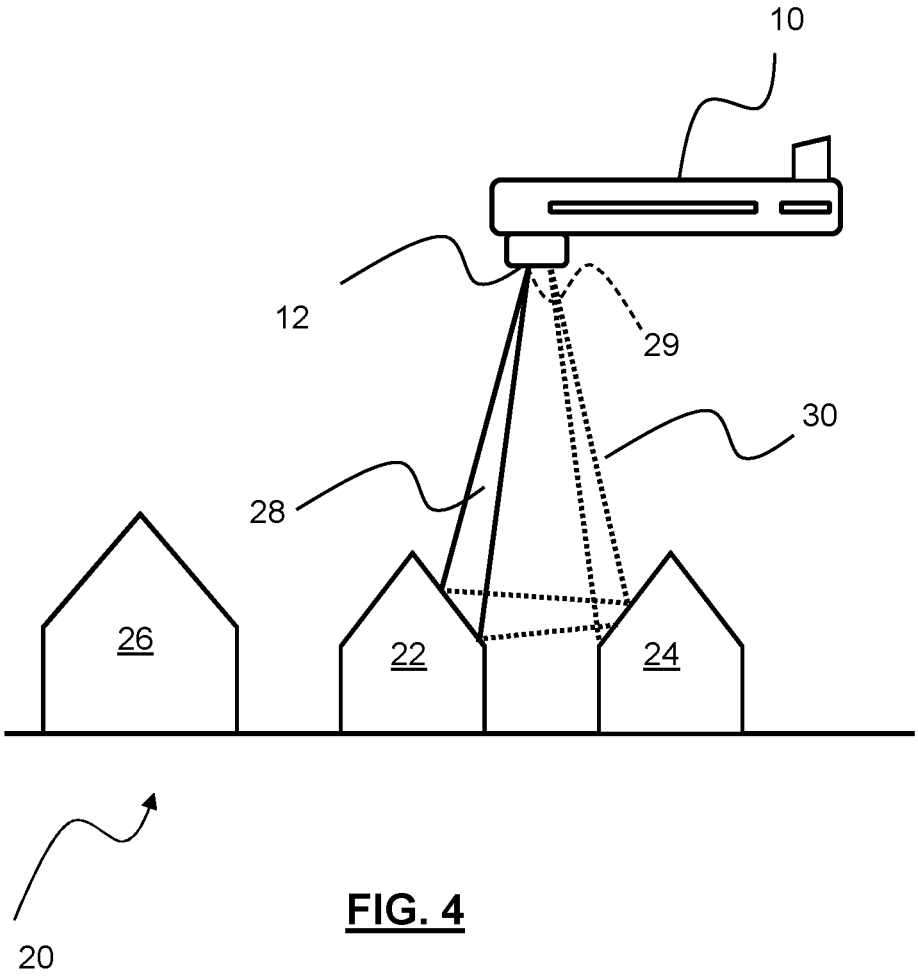
FIG. 4 shows a side view of the vehicle during an assessment phase, according to an example embodiment.

Referring to FIG. 4 in combination with FIG. 3 and FIG. 1, there is shown the military vehicle 10 travelling near to the target environment 20. In FIG. 4, the apparatus 12 is performing an assessment of the target environment 20.

In order to perform the assessment of the target environment 20, the controller 16 controls the directed-energy weapon 18 to direct energy 28 towards the target environment 20. During the assessment phase 102, the controller 16 controls the directed-energy weapon 18 to use a main beam 29 of the directed-energy weapon to direct the energy 28 towards the target environment 20.

During the assessment phase 102, the controller 16 controls the directed energy weapon 18 to direct energy at a lower power than during the engaging phase 104 (as described below). This means that the power received by the target environment 20 during the assessment phase 102 is lower, reducing (and perhaps even eliminating) the risk of collateral damage, and/or perhaps reducing the damage caused to the target during this phase.

Additionally, during the assessment phase 102, the controller 16 controls the directed energy weapon 18 to direct energy at a higher beam divergence than during the engaging phase 104 (as described below). This means that the power per unit area received by the target environment 20 during the assessment phase 102 is lower, reducing the risk of collateral damage at this time. Alternatively, an increased beam divergence might also lead to an increased mapping or data extraction capability, due to more divergent/more angular beam paths. In other examples, the controller 16 controls the directed energy weapon 19 to pulse directed energy toward the target environment 20 to reduce the energy received during the assessment phase 102.

The assessment comprises determining a possible engagement efficiency of the target by the directed-energy weapon 16. The engagement efficiency is the proportion of energy directed towards the target environment 20 during the engaging phase 104 which would pass into a target 22, i.e. be absorbed and not reflected/deflected.

The assessment system 14 detects energy 30 deflected from the target environment 20 to determine possible engagement efficiency. It will be understood that, in general, the more energy that is deflected from the target environment 20, the lower the possible engagement efficiency and/or the higher the risk of significant collateral damage. It will be appreciated that this may all change over time, for example as an area on a target becomes more absorptive/susceptible to damage from incoming energy. That is, directed energy may initially be lower to reduce collateral damage, until the energy damages/affects the target so that the target become more absorptive/susceptible to damage from incoming energy, at which point/time the directed energy may be increased in terms of power. In other words, the target may initially be more reflective than it is at a later time in the engagement, and power levels may be controlled accordingly. Additionally, the possible engagement efficiency may vary over time due to changes in engagement angle or range.

Additionally, the assessment system 14 may measure the temperature of the target 22 (e.g. the part being engaged or otherwise receiving energy) to determine the possible engagement efficiency. Measuring the temperature of the target 22 allows the amount of energy deflected from/coupled into the target 22 to be calculated, thereby providing a measure of possible engagement efficiency. Thermal imaging may be used to measure the temperature.

The assessment may further comprise receiving, by the assessment system 14, data relating to a map of at least a portion of a target environment 20. More specifically, the assessment comprises mapping the (at least a portion of the) target environment 20 to obtain the data relating to the map.

Figure 5:
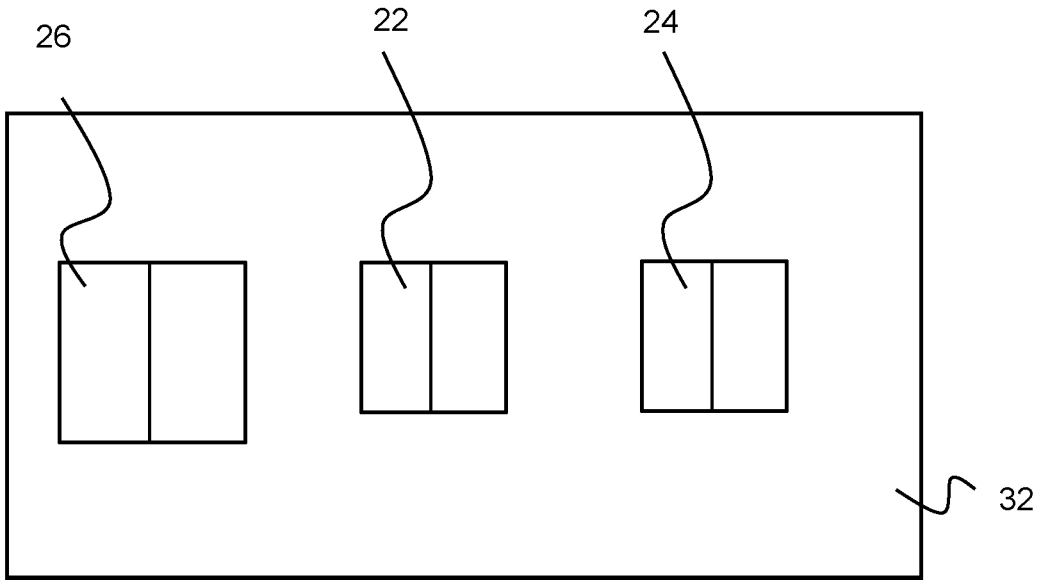
FIG. 5 shows a top-down map view, according to an example embodiment.

In one example, the assessment system 14 may receive such data in advance, or even from a data store or similar. In this example, however, the assessment system 14 detects energy 30 deflected from the target environment 20 to obtain the data relating to the map. This is illustrated by FIG. 5, which shows a map 32 produced from the deflected energy 30. As can be seen, the map 32 shows the position of the target 22 along with the first adjacent object 24 and the second adjacent object 26. In order to produce such a map 32, the controller might control the directed-energy weapon 18 to sweep directed energy 28 across different points in the target environment 20. As well as allowing a detailed map to be built up, sweeping the directed energy 28 in this way means that the energy received by each point in the target environment 20 is reduced, thereby possibly reducing the risk of collateral damage, at least in this mapping phase.

In other examples, a separate system may be used to perform the mapping (for example, a LIDAR system), or the data relating to the map may be obtained from a previously produced map.

In some examples, data relating to a map may be obtained from a previously produced map and combined with live mapping (for example, using a LIDAR system or the assessment system described above) to form a more detailed map. This is advantageous, as it means that more permanent features (for example, road layouts) may be taken from the previously produced map, while live mapping may be used to map features more likely to vary overtime (for example, locations of vehicles).

During the assessment phase 102, the controller 18 receives information on a speed and direction of travel of the apparatus 12 (i.e. the speed and direction of travel of military vehicle 10). The apparatus 12 uses the information and the map to determine a time for which there is a continuous line of sight from the directed-energy weapon 18 to the target 22. In the example of FIG. 4, as the military vehicle 10 passes the target 22, the military vehicle 10 will reach a point at which the second adjacent object 26 is between the apparatus 12 and the target 22, and there will be no direct line of sight from the directed-energy weapon 18 to the target 22. In order to reduce collateral damage, it is desirable to avoid trying to engage the target 22 with the directed-energy weapon 18 when there is no direct line of sight.

A speed and direction of travel of the target, if applicable, might also be used to factor in possible engagement efficiency at some future point in time.

During the assessment phase 102, the controller 16 uses the map to determine an angle of at least a region of the target 22. This allows a further calculation of possible engagement efficiency to be made, since the angle affects the amount of energy absorbed by, or deflected from, the target 22. Deflected energy might also be used to determine such an angle.

Based on the possible engagement efficiency, the apparatus 12 determines risk of collateral damage. Additionally, the apparatus 12 uses the map 32 to consider the types of objects (or more generally, an assessment of objects) present in the target environment 20 to determine the risk of collateral damage by considering the possible consequences of damage to those objects.

Following the assessment phase 102, the apparatus enters the engaging phase 104, during which the controller 16 controls the directed-energy weapon 18 to direct energy towards the target 22 conditionally upon the possible engagement efficiency, and/or the time for which there is a continuous line of sight from the directed-energy weapon 18 to the target 22 and/or the risk of collateral damage. The controller 16 controls the directed-energy weapon 18 to direct energy during the engaging phase 104 using the main beam 29.

Figure 6:
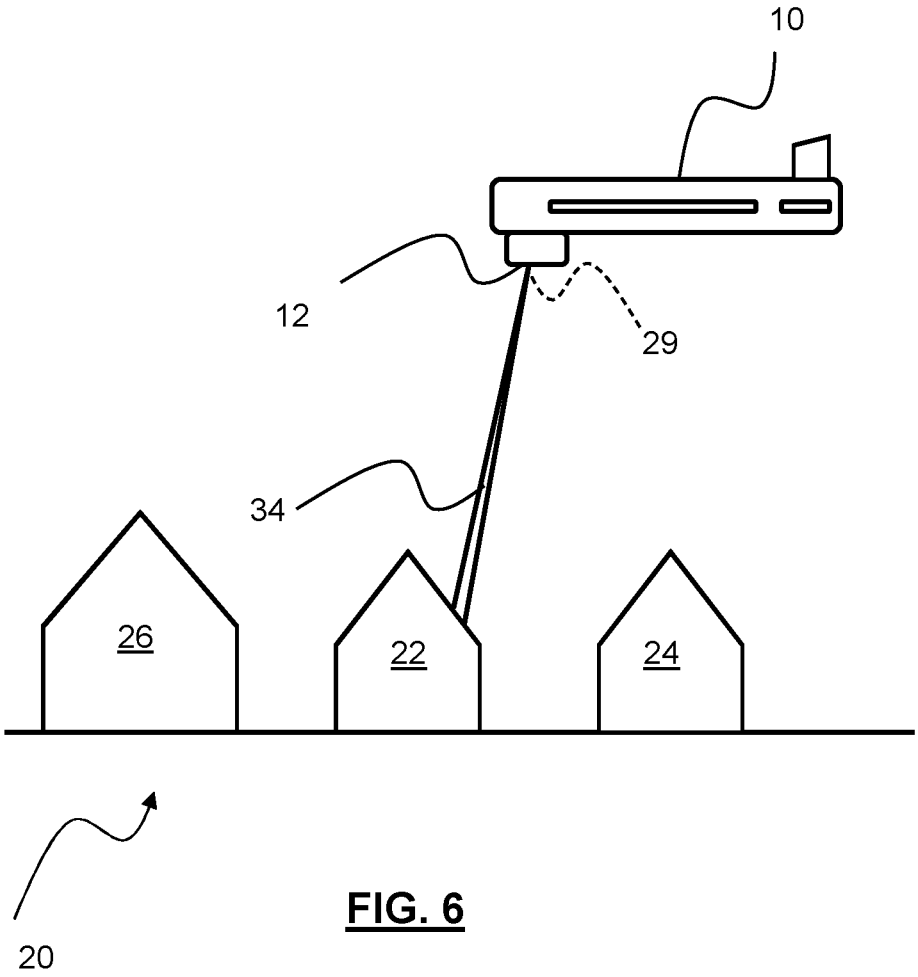
FIG. 6 shows a side view of the vehicle during an engaging phase, according to an example embodiment.

In some examples, in response to the possible engagement efficiency being above a first predetermined level, the controller 16 controls the directed-energy weapon 18 to direct energy 34 towards the target environment 20 (more specifically, towards the target 22). This is illustrated by FIG. 6. However, in response to the possible engagement efficiency being below the first predetermined level, the controller 16 controls the directed-energy weapon 18 not to direct energy towards the target environment 20. This may reduce the risk of collateral damage, or avoid engaging the target when such engagement will be neither satisfactory nor successful.

In response to the possible engagement efficiency being below a second predetermined level (but above the first predetermined level), the controller 16 controls the directed energy weapon 18 to direct energy towards the target environment at a first power level, and, in response to the possible engagement efficiency being above the second predetermined level, the controller 16 controls the directed energy weapon 18 to direct energy towards the target environment 20 at a second power level, which is greater than the first power level. This helps to avoid collateral damage in situations in which the possible engagement efficiency is less than the second predetermined level, whilst allowing the directed-energy weapon 18 to engage the target.

Similarly, in some examples, in response to the time for which there is a continuous line of sight from the directed-energy weapon to the target being below a first predetermined level, the controller 16 controls the directed-energy weapon 18 not to direct energy towards the target (or direct energy at a lower power), and, in response to the time for which there is a continuous line of sight from the directed-energy weapon to the target being above the first predetermined level, the controller 16 controls the directed energy weapon 18 to direct energy towards the target. Again, this helps to avoid collateral damage when the time for which there is a continuous line of sight is too low, and/or improves the chances of successfully or satisfactorily engaging the target.

In some cases, the controller 16 controls the directed-energy weapon 18 conditionally upon the risk of collateral damage, which may be determined based on the possible engagement efficiency, and/or time for which there is a continuous line of sight and/or the types of objects in the target environment as described above. If the risk of collateral damage is too high, the controller 16 controls the directed-energy weapon 18 not to direct energy towards the target environment 20. If the risk of collateral damage is at an intermediate level, the controller 16 controls the directed-energy weapon 18 to direct energy towards the target environment 20 at a lower power than when the risk of collateral damage is low.

Additionally, in some examples (for example where the possible engagement efficiency and/or the time for which there is a continuous line of sight is below a predetermined level, and/or the risk of collateral damage is above a predetermined level) the apparatus carries out a step of performing a second assessment of the target environment 20 during the second assessment phase 106. The second assessment is centred on a different point to the assessment of the target environment 20 carried out in the first assessment phase 102, but is performed as above. This may be at a different position on the target, or on a different target altogether. After performing the second assessment, the results are considered, and there may be further assessments or engaging phases, as described above. In some examples, the second assessment may be carried out even where the target 22 is engaged, in order to find a better way to engage the target 22 in a subsequent engaging phase. That is, the assessment and engage phases may be undertaken in sequence, with a degree of temporal overlap, or in parallel. For example, there may be intermittent assessment phases or intermittent engaging phases, and/or there may be intermittent assessment phases interspersed with intermittent engaging phases. There may be intermittent assessment phases at the same as a relatively constant or at least continuous engaging phase, or there may be intermittent engaging phases at the same as a relatively constant or at least continuous assessment phase. These different options allow for flexible engagement and assessment, which might improve target engagement in terms of efficiency, at least, as opposed to only a single assess and engage process.

While the above examples describe that the apparatus 12 comprises the directed-energy weapon 18, this is not always the case, and that the controller 16 may control a directed-energy weapon which is remote to the apparatus 12.

Additionally, it has been described in the above examples that during an assessment phase, the controller controls the directed-energy weapon to use the main beam (which is also used during the engaging phase) to direct energy. However, this is not always the case, as the vehicle may comprise a dedicated probing beam to be used during the assessment phase. This probing beam may be lower power than the main beam and may be designed specifically for performing the assessment during the assessment phase. It will be appreciated that in either case, beam optics are provided to form the main and/or probing beams.

More generally FIG. 1 might relate to an apparatus 12 for a directed-energy weapon 18, the apparatus 12 comprising an assessment system 14 arranged to perform an assessment of a target environment 20, wherein the target environment 20 comprises a target 22, and the assessment comprises determining a possible engagement efficiency of the target 22 by the directed-energy weapon 18; and a controller 16 arranged to, during an engaging phase, control the directed-energy weapon 18 to direct energy towards the target environment 20 (and more specifically, the target 22) conditionally upon the possible engagement efficiency.

Additionally or alternatively, FIG. 1 might relate to an apparatus 12 for a directed-energy weapon 18, the apparatus 12 comprising an assessment system 14 arranged to perform an assessment of a target environment 20, wherein the target environment 20 comprises a target 22, and the assessment comprises receiving data relating to a map of at least a portion of the target environment 20; and a controller 16 arranged to, during an engaging phase, control the directed-energy weapon 18 to direct energy towards the target environment 20 conditionally upon the data received.

Additionally or alternatively, FIG. 1 might relate to an apparatus 12 for a directed-energy weapon 18, the apparatus 12 comprising: an assessment system 14 arranged to perform an assessment of a target environment 20, wherein the target environment 20 comprises a target 22; and a controller 16 arranged to, during the assessment, control the directed energy weapon 18 to direct energy towards the target environment 20 so that the assessment system 14 can perform the assessment using the directed energy.

More generally FIG. 3 might relate to a method 100 of engaging a target 22, the method 100 comprising: during an assessment phase 102, performing an assessment of a target environment 20, wherein the target environment 20 comprises a target 22, and the assessment comprises determining a possible engagement efficiency of the target 22 by a directed-energy weapon 18; and during an engaging phase 104, controlling the directed-energy weapon 18 to direct energy towards the target environment 20 conditionally upon the possible engagement efficiency of the target 22.

Additionally or alternatively, FIG. 3 might relate to a method 100 of engaging a target 22, the method comprising: during an assessment phase 102, receiving data relating to a map of at least a portion of a target environment 20, the target environment 20 comprising a target 22; and during an engaging phase 104, controlling a directed-energy weapon 18 to direct energy towards the target environment 20 conditionally upon the map.

Additionally or alternatively, FIG. 3 might relate to a method 100 comprising, during an assessment phase 102, performing an assessment of a target environment 20 by controlling a directed-energy weapon 18 to direct energy, wherein the target environment 20 comprises a target 22, and using the directed energy to perform the assessment.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An apparatus for a directed-energy weapon, the apparatus comprising: an assessment system arranged to, during an assessment phase, perform an assessment of a target environment, wherein the target environment comprises a target, and the assessment comprises receiving data relating to a map of at least a portion of a target environment; and a controller arranged to, during the assessment phase, control the directed-energy weapon to direct energy so that the assessment system can use the directed energy to perform the assessment, and during an engaging phase, control the directed-energy weapon to direct energy towards the target environment conditionally upon the data, such that the target environment receives a lesser energy from the directed-energy weapon during the assessment phase than during the engaging phase; and wherein the controller is arranged to: receive information on a speed and direction of travel of the apparatus during the assessment phase, and use the information and the data relating to the map to determine a time for which there is a continuous line of sight from the directed-energy weapon to the target, and during the engaging phase, control the directed-energy weapon to engage the target conditionally upon the time for which there is the continuous line of sight to reduce a risk of collateral damage.

2. The apparatus according to claim 1, wherein the assessment comprises mapping at least a portion of the target environment to obtain the data relating to the map.

3. The apparatus according to claim 2, wherein the controller is arranged to control the directed-energy weapon to use a main beam to direct energy during both the assessment phase and the engaging phase.

4. The apparatus according to claim 3, wherein the controller is arranged to, during the engaging phase: in response to the time for which there is the continuous line of sight from the directed-energy weapon to the target being below a first predetermined level, control the directed energy weapon not to direct energy towards the target; and in response to the time for which there is the continuous line of sight from the directed-energy weapon to the target being above the first predetermined level, control the directed energy weapon to direct energy towards the target.

5. The apparatus according to claim 2 wherein the controller is arranged to, during the assessment phase, control the directed energy weapon to: direct energy at a lower power than during the engaging phase; direct energy at a higher beam divergence than during the engaging phase; sweep directed energy across different points in the target environment; and/or pulse directed energy toward the target environment.

6. The apparatus according to claim 2, wherein the controller is arranged to, during the assessment phase, control the directed-energy weapon to use a probing beam to direct energy, and, during the engaging phase, control the directed-energy weapon to use a main beam to direct energy.

7. The apparatus according to claim 1, wherein the assessment comprises determining an angle of a region of the target to determine a possible engagement efficiency of the target by the directed-energy weapon; and the controller is arranged to, during the engaging phase, control the directed-energy weapon to direct energy towards the target environment conditionally upon the possible engagement efficiency of the target.

8. The apparatus according to claim 7, wherein the controller is arranged to, during the engaging phase:

in response to the possible engagement efficiency being below a first predetermined level, control the directed-energy weapon not to direct energy towards the target environment; and in response to the possible engagement efficiency being above the first predetermined level, control the directed-energy to direct energy towards the target environment.

9. The apparatus according to claim 1, wherein the controller is arranged to, during the engaging phase:

in response to the possible engagement efficiency being below a second predetermined level, control the directed energy weapon to direct energy towards the target environment at a first power level; and in response to the possible engagement efficiency being above the second predetermined level, control the directed energy weapon to direct energy towards the target environment at a second power level, wherein the second power level is greater than the first power level.

10. The apparatus according to claim 1, wherein the assessment comprises determining the risk of collateral damage by using the map to determine objects adjacent to the target, and wherein the controller is arranged to, during the engaging phase, control the directed-energy weapon to direct energy towards the target environment conditionally upon the risk of collateral damage.

11. The apparatus according to claim 1, and further comprising the directed-energy weapon, wherein the directed-energy weapon is optionally a laser.

12. A military vehicle comprising the apparatus of claim 1, wherein the military vehicle is an aircraft.

13. A method of engaging a target by a directed-energy weapon, the method comprising: during an assessment phase, receiving data relating to a map of at least a portion of a target environment, the target environment comprising a target; and during the assessment phase, controlling the directed-energy weapon to direct energy so that the assessment system can use the directed energy to perform an assessment of the target environment, receiving information on a speed and direction of travel of the apparatus, and using the information and the data relating to the map to determine a time for which there is a continuous line of sight from the directed-energy weapon to the target; and during an engaging phase, controlling the directed-energy weapon to engage the target conditionally upon the time for which there is the continuous line of sight to reduce a risk of collateral damage; wherein the target environment receives a lesser energy from the directed-energy weapon during the assessment phase than during the engaging phase.

* * * * *